US006926498B2

(12) United States Patent
Li et al.

(10) Patent No.: US 6,926,498 B2
(45) Date of Patent: Aug. 9, 2005

(54) HUB OF FAN WHEEL WITH IMPROVED ATTACHMENT FOR METAL CASE

(75) Inventors: Nien-Lun Li, Hsin-Chuang (TW); Fu-Yin Wang, Hsin-Chuang (TW)

(73) Assignee: Datech Technology Co., Ltd., Taipei Hsien (TW)

( * ) Notice: Subject to any disclaimer, the term of this patent is extended or adjusted under 35 U.S.C. 154(b) by 0 days.

(21) Appl. No.: 10/691,620

(22) Filed: Oct. 24, 2003

(65) Prior Publication Data

US 2005/0074336 A1 Apr. 7, 2005

(51) Int. Cl.[7] ..... F04D 29/32

(52) U.S. Cl. ..... 416/3; 416/170 R; 416/244 R; 417/354; 417/360; 417/423.1; 310/156.26

(58) Field of Search ..... 416/3, 170 R, 416/244 R, 245; 415/10; 417/353–354, 360, 417/423.1; 310/156.12, 156.13, 156.26, 52, 310/58

(56) References Cited

U.S. PATENT DOCUMENTS 5,099,181 A * 3/1992 Canon ..... 417/354
6,196,802 B1 * 3/2001 Matsumoto ..... 416/244 R
6,447,272 B2 * 9/2002 Tsuchiya ..... 417/354
6,551,074 B2 * 4/2003 Kudo et al. ..... 417/354
6,616,422 B2 * 9/2003 Hsieh ..... 417/354
6,674,204 B1 * 1/2004 Horng et al. ..... 310/156.12
2004/0191088 A1 * 9/2004 Matsumoto ..... 417/354

* cited by examiner

*Primary Examiner*—Christopher Verdier
(74) *Attorney, Agent, or Firm*—Troxell Law Office, PLLC

(57) ABSTRACT

A hub of a fan wheel with improved attachment for a metal case. The fan wheel is composed of a hub with a storage portion and a plurality of blades arranged around circumference of the hub. A metal case with a magnetic part is disposed in the storage portion of the hub. A plurality of blocking chunks is disposed in the end side of the storage portion of the hub, and at least one hook is disposed at proper position in the end side of the storage portion of the hub. A plurality of ribs is disposed inside the storage portion of the hub. The metal case has a penetrated hole with a stopper in one end of the penetrated hole. A recess is set between the stopper and the magnetic part. Therefore, when the metal case is disposed in the storage portion, by hooking the hook in the end side of the storage portion of the hub in the recess between the magnetic part and the stopper and positioning the metal case with blocking chunks and ribs, the metal case is firmly attached in the storage portion of the hub so as to improve attachment and facilitate manufacture.

1 Claim, 5 Drawing Sheets

HUB OF FAN WHEEL WITH IMPROVED ATTACHMENT FOR METAL CASE

FIELD OF THE INVENTION

The present invention relates to a hub of fan wheel with improved attachment for a metal case. More particularly, when the metal case is disposed in a storage portion of the hub, by hooking a hook in the end side of the storage portion of the hub in a recess between a magnetic part and a stopper and positioning the metal case with blocking chunks and ribs, the metal case is firmly attached in the storage portion of the hub so as to improve attachment and facilitate manufacture.

BACKGROUND OF THE INVENTION

A prior art of a fan motor for fixing disclosed in the Taiwan Patent No. 395625 comprises:

a frame body;

an impeller disposed in said frame body;

a cover disposed in said impeller;

a bushing with one end connecting to said frame body;

a stator disposed in said cover and connected to said bushing;

a printed circuit board disposed between said stator and said frame body and connected to said bushing; and a first fixing means, disposed between said cover and said stator, mounted on said bushing by hooking, so as to axially fix said stator;

A second fixing means, disposed between said stator and said printed circuit board, with said bushing passing through and axially fixed with the stator to fix the printed circuit board on said frame body.

Although the fan motor for fixing mentioned above can fix the printed circuit board on said frame body, since the cover is fixed in an inner covering of the impeller by a plurality of holes in one end and a plurality of hooks in the inner covering of the impeller, when fabricating the cover, those holes must exactly correspond to those hooks in the inner covering of the impeller so as to fix the cover in the inner covering of the impeller. Therefore, it is inconvenient for fabricating. Thus, the conventional fan motor can not meet a users' need.

SUMMARY OF THE INVENTION

The main objective of the present invention is to provide a hub of fan wheel with improved attachment for a metal case. More particularly, when the metal case is disposed in a storage portion of the hub, by hooking a hook in the end side of the storage portion of the hub in a recess between a magnetic part and a stopper and positioning the metal case with blocking chunks and ribs, the metal case is firmly attached in the storage portion of the hub so as to improve attachment and facilitate manufacture.

To achieve the above objective, in the hub of the fan wheel of the present invention, the fan wheel is composed of a hub with a storage portion and a plurality of blades arranged around the circumference of the hub. A metal case with a magnetic part is disposed in the storage portion of the hub. A plurality of blocking chunks is disposed in the end side of the storage portion of the hub, and at least one hook is disposed at proper position in the end side of the storage portion of the hub. A plurality of ribs is disposed inside the storage portion of the hub. The metal case has a penetrated hole with a stopper in one end of the penetrated hole. A recess is set between the stopper and the magnetic part. Therefore, when the metal case is disposed in the storage portion, by hooking the hook in the end side of the storage portion of the hub in the recess between the magnetic part and the stopper and positioning the metal case with blocking chunks and ribs, the metal case is firmly attached in the storage portion of the hub so as to improve attachment and facilitate manufacture.

BRIEF DESCRIPTION OF THE DRAWINGS

The present invention will be better understood from the following detailed description of the invention, taken in conjunction with the accompanying drawings, in which.

DETAILED DESCRIPTION OF THE INVENTION

The following descriptions of the preferred embodiments are provided to understand the features and the structures of the present invention.

Figure 1:
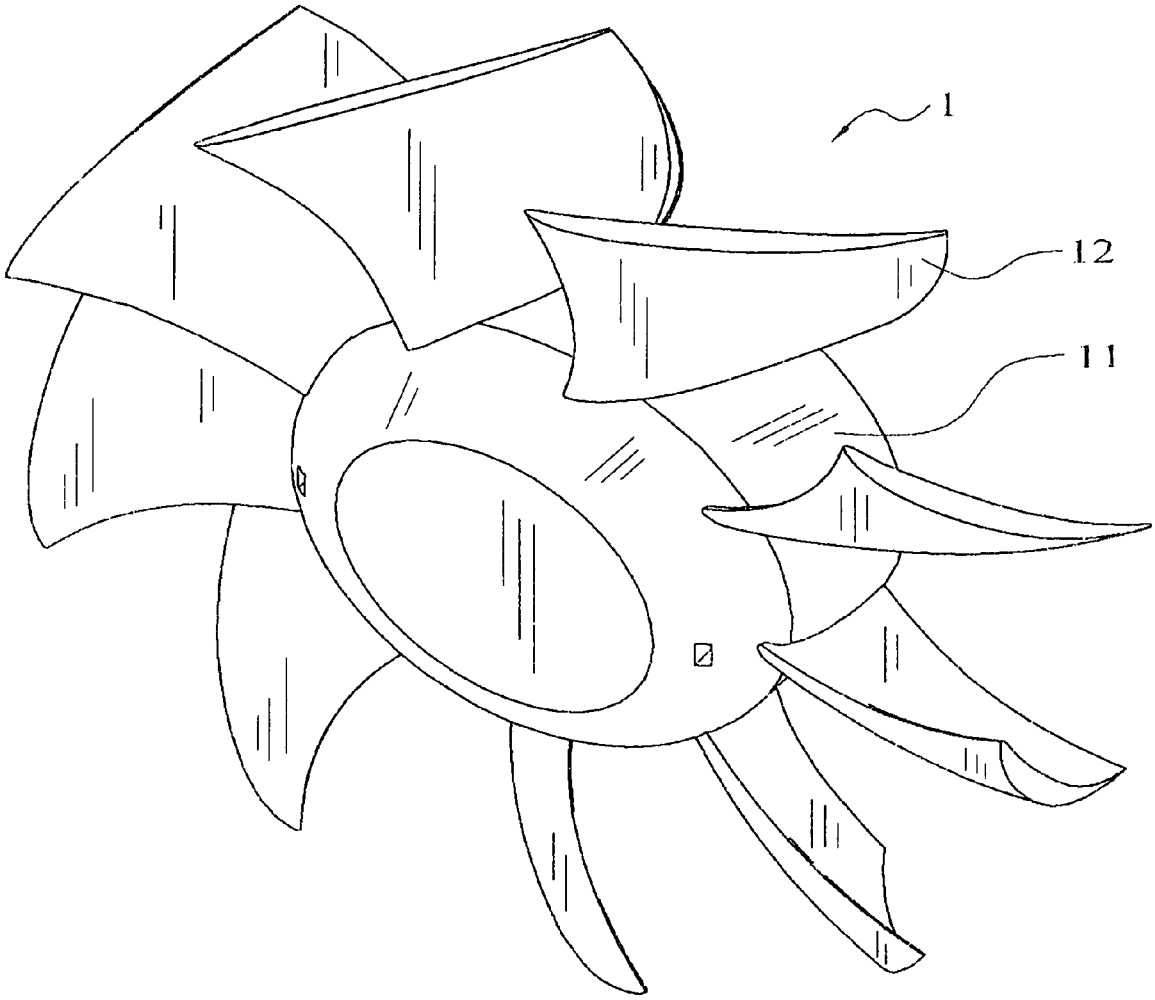
FIG. 1 is a diagram showing the present invention.
Figure 2:
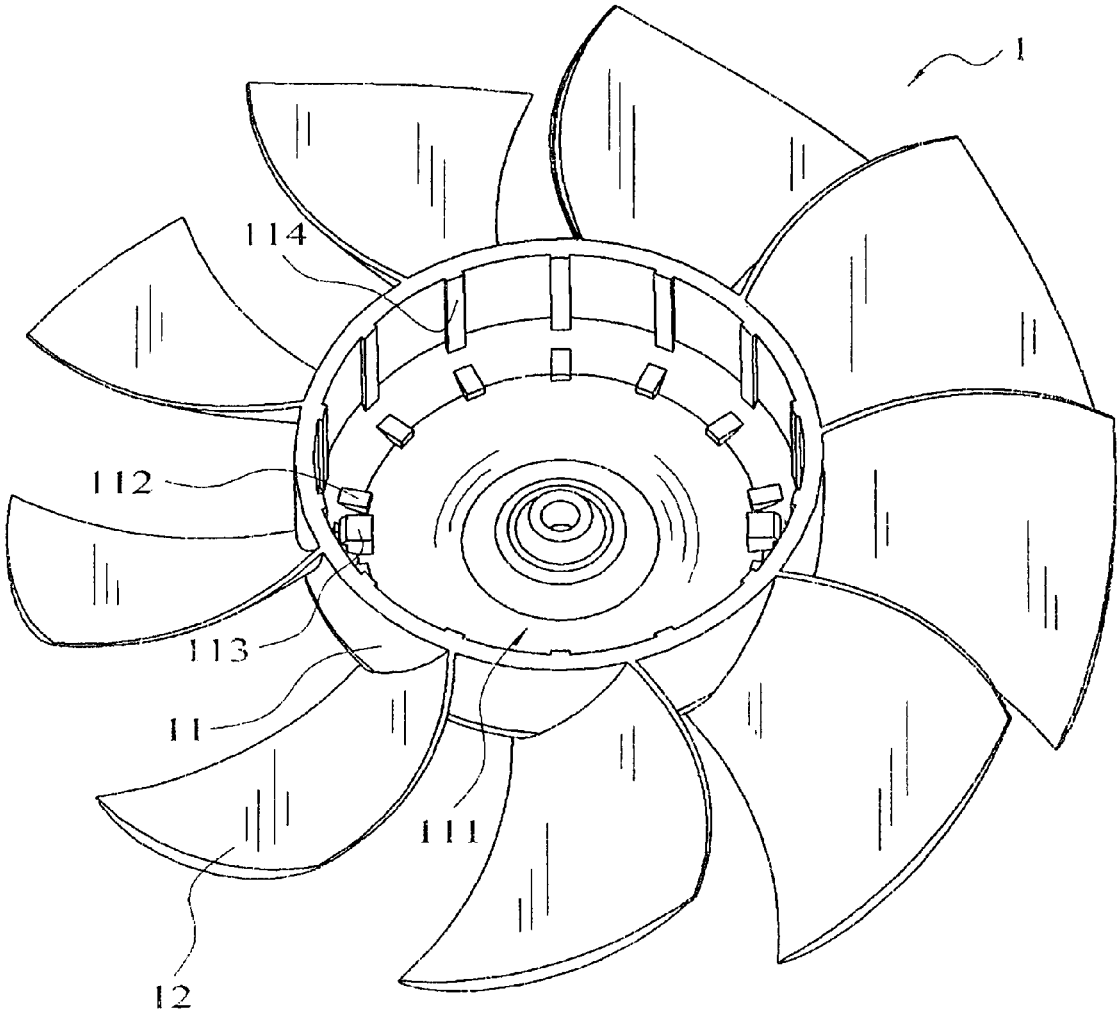
FIG. 2 is a diagram showing the present invention in another viewing angle.
Figure 3:
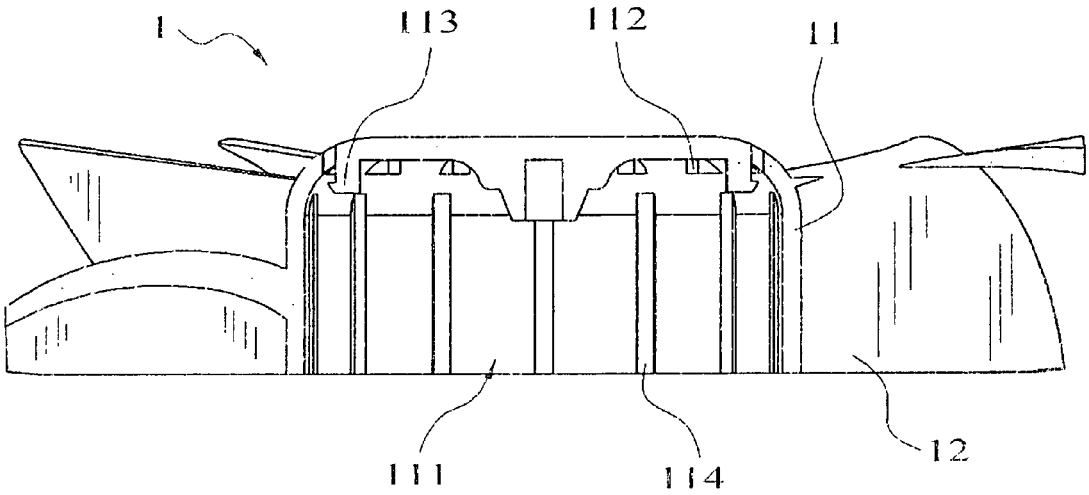
FIG. 3 is a cross-section diagram of the present invention.
Figure 4:
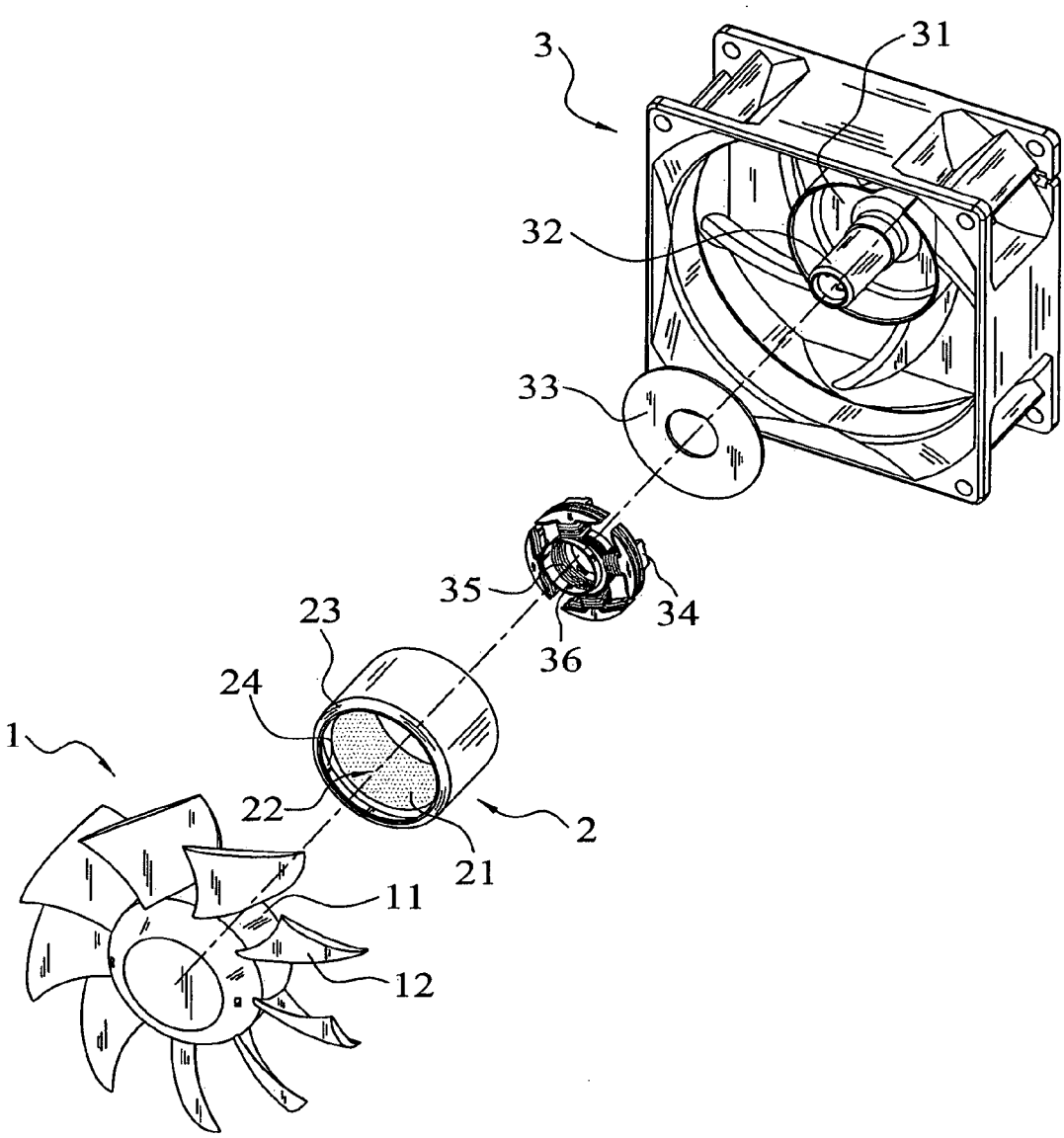
FIG. 4 is a diagram showing a view in combination configuration of the present invention and the frame body.
Figure 5:
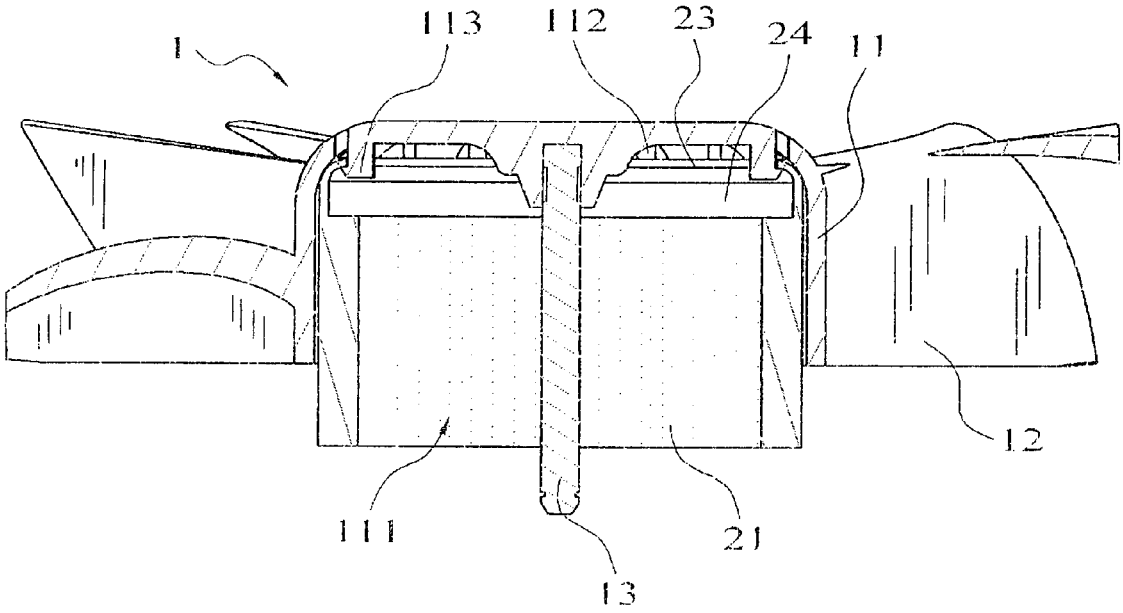
FIG. 5 is a diagram showing a view in combination configuration of the hub of the present invention and a metal case.

FIG. 1 to FIG. 5 are respectively a diagram showing an outward appearance of the present invention, a diagram showing an outward appearance of the present invention in another viewing angle, a cross-section diagram of the present invention, a diagram showing a view in combination configuration of the present invention and frame body, and a diagram showing a view in combination configuration of the hub of the present invention and a metal case. As shown in the diagrams, the present invention provides a hub of fan wheel with improved attachment for a metal case, which comprises a fan wheel 1 and a metal case 2 with a magnetic part 21.

The fan wheel 1 is composed of a hub 11 with a storage portion 111 and a plurality of blades 12 arranged around circumference of the hub 11. An axis shaft 13 is disposed in the center of the storage portion 111 of the hub 11. A plurality of blocking chunks 112 are disposed in the end side of the storage portion 111 of the hub 11, and at least one hook 113 is disposed at proper position in the end side of the storage portion 111 of the hub 11. The hook 113 is in a hook-like shape. A plurality of ribs 114 is disposed inside the storage portion 111 of the hub 11.

The metal case 2 with the magnetic part 21 is disposed in the storage portion 111 of the hub 11. The metal case 2 has a penetrated hole 22 with a stopper 23 in one end of the penetrated hole 22. A recess 24 is set between the stopper 23 in one end of the penetrated hole 22 and the magnetic part 21. Therefore, the above structure forms a novel hub of fan wheel.

While operation, the hub of fan wheel of the present invention is installed in a frame body 3 with a supporting portion 31 in its center. Above the supporting portion 31, there is a bushing 32 being inserted on a shaft 13 of the hub 11. A circuit board 33, a lower bobbin 34, a coiling set 35 and a upper bobbin 36 are disposed at outer part of the bushing 32. The magnetic part 21 in the metal case 2 is installed at outer part of the lower winding set 34, coiling set 35 and upper winding set 36 mention above, so as to form a fan. When the metal case 2 with the magnetic part 21 is going to be disposed in the storage portion 111 of the hub 11, one end of the metal case 2 which has a stopper 23, corresponding to the storage portion 111 of the hub 11, is inserted, so that a plurality of blocking chunks 112 in end side of the storage portion 111 can block the stopper 23 in one end of the metal case 2 and position the metal case 2 with a predetermined height in the storage portion 111 of the hub 11. From the time being, by at least one the hook 113 in a hook-like shape in one end of the storage portion 111, the hub 11 is hooked in the recess 24 between the magnetic part 21 and the stopper 23 in one end of the metal case 2. Moreover, by a plurality of ribs 114 disposed inside of the storage portion 111 of the hub 11, more friction between the outer part of the metal case 2 and the inner part of the hub 11 is generated. Therefore, the metal case 2 is firmly attached in the storage portion 111 of the hub 11 so as to improve attachment between the metal case 2 and the hub 11 and further facilitate manufacture.

When the metal case is disposed in the storage portion, by hooking the hook in the end side of the storage portion of the hub in the recess between the magnetic part and the stopper and positioning the metal case with blocking chunks and ribs, the metal case is firmly attached in the storage portion of the hub so as to improve attachment and facilitate manufacture. Furthermore, the hub 11 can be selected from a group consisting of an axial type hub of fan wheel, a radical type hub of fan wheel, a mixed-flow type hub of fan wheel, and a cross-flow type hub of fan wheel.

The description mention above is only a preferred embodiment of the present invention, which is not a limitation to the scope of the claimed invention. Therefore, any modification and variation in according with the claims and the specification of the present invention shall be covered within the scope of the present invention.

What is claimed is:

1. A fan wheel assembly comprising:

a hub having a storage portion and a plurality of blades arranged around a circumference of said hub, an axis shaft is disposed in a center of said storage portion; and a metal case with a magnetic part is located in said storage portion of said hub;

a plurality of blocking chunks are located on an end of said storage portion of said hub, at least one hook is disposed at a predetermined position in the end of said storage portion of said hub, and a plurality of ribs are disposed inside said storage portion of said hub; and said metal case has a penetrated hole with a stopper in one end of said penetrated hole, a recess is located between said stopper and said magnetic part;

whereby, when said metal case is disposed in said storage portion, said hook in said end of said storage portion of said hub hooking in said recess between said magnetic part and said stopper and positioning said metal case with said blocking chunks and ribs, said metal case is firmly attached in said storage portion.

* * * * *